US006481575B2

(12) United States Patent
Cipriani

(10) Patent No.: US 6,481,575 B2
(45) **Date of Patent: *Nov. 19, 2002**

(54) CARDBOARD BOX FOR CONTAINING AND DISPENSING LARGE QUANTITIES OF WIRE

(75) Inventor: Giancarlo Cipriani, Bibbiena Stazione (IT)

(73) Assignee: C.I.F.E. S.r.l., Arezzo (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/826,890

(22) Filed: Apr. 6, 2001

(65) Prior Publication Data

US 2001/0013479 A1 Aug. 16, 2001

Related U.S. Application Data

(63) Continuation of application No. 09/461,378, filed on Dec. 15, 1999.

(30) Foreign Application Priority Data

May 31, 1999 (EP) ..... 99830333

(51) Int. Cl.[7] ..... B65D 85/66

(52) U.S. Cl. ..... 206/408; 206/397; 206/410; 220/495.01; 220/495.11

(58) Field of Search ..... 206/408, 386, 206/395, 397, 410, 586; 242/170, 171, 172; 220/495.01, 495.11, 495.06

(56) References Cited

U.S. PATENT DOCUMENTS

| | | | |
|---|---|---|---|
| 3,244,347 | A | 4/1966 | Jenk |
| 3,648,920 | A | 3/1972 | Stump |
| 4,013,168 | A | 3/1977 | Bamburgh et al. |
| 4,160,533 | A | 7/1979 | Kotzur et al. |
| 4,549,673 | A | 10/1985 | Kupersmit |
| 4,623,063 | A | 11/1986 | Balkin |
| 4,724,960 | A | 2/1988 | Goodrum et al. |
| 4,974,291 | A | 12/1990 | McNerney |
| 5,105,943 | A | 4/1992 | Lesko et al. |
| 5,328,028 | A | 7/1994 | Hale et al. |
| 5,374,005 | A | 12/1994 | Jenkins et al. |
| 5,494,160 | A | 2/1996 | Gelmetti |
| 5,735,429 | A | 4/1998 | Whitworth |
| 5,746,380 | A | 5/1998 | Chung |
| 5,808,796 | A | 9/1998 | Abe et al. |
| 5,819,934 | A | 10/1998 | Cooper |

FOREIGN PATENT DOCUMENTS

| | | |
|---|---|---|
| FR | 2 747 995 | 10/1997 |
| GB | 2 092 110 | 8/1982 |
| WO | 94/19258 A1 | 9/1994 |
| WO | 98/52844 A1 | 11/1998 |

*Primary Examiner*—Shian Luong
(74) *Attorney, Agent, or Firm*—Browdy and Niemark, P.L.L.C.

(57) ABSTRACT

The cardboard box for containing and dispensing large quantities of wire, especially metal wire for welding, comprises a cubic external container with an open top side, an octagonal-base internal container, fitting snugly into the external container and being destined to contain a coil of wire, and a bag-type wrapper made of a flexible airtight material, which is interposed between the external and the internal containers so as completely to cover the internal container and able to be closed and sealed there-upon.

25 Claims, 2 Drawing Sheets

CARDBOARD BOX FOR CONTAINING AND DISPENSING LARGE QUANTITIES OF WIRE

This application is a continuation of Ser. No. 09/461,378 filed Dec. 15, 1999.

BACKGROUND OF THE INVENTION

Special reference is made to boxes destined to contain coils of large quantities of metal wire, in particular welding wire, with weights going from about 50 kg. up to 400 kg.

The use of such large coils means that automatic welding machines, which are fed with the wire, can operate for continuous and extensive time periods. The functions, feeding-in and unwinding modes, as well as the type of stresses the boxes are subject to, all lead to very considerable specialisation in their design, i.e. very different to the design specifications required for other types of containers or packaging.

First of all, the continuous wire is deposited inside the container in such a way that it can be dispensed there-from without risk of tangling; special geometrical arrangements are already known for introducing the wire (not of direct interest to the present invention, which uses known techniques), as are central reels which prevent the wire from moving about during transport. The wire is introduced into the box by special machines having platforms on which the empty boxes are placed and from which, once filled, they are removed with the help of special machines (due to their weight). The box must therefore be of an easily manoeuvrable type, whether empty or full.

The box must also be sufficiently sturdy to withstand lateral stresses, which might otherwise cause unacceptable deformations in the shape of the box itself and the coil of wire contained therein, as well as axial stresses, so that several boxes can be piled one on top of another without crushing any one box. These stresses may be of quite large entity, especially if one considers the amount of movement the boxes are subject to at the various phases, such as when they are at the wire producer's plant, when they are being loaded or unloaded (into a lorry, train or even a ship), as well as when they are being delivered to the eventual user.

The box must also be conformed so that it does not in any way negatively influence the unwinding of the wire. Before it is filled, the box has to be as easy as possible to move and store. Once the wire has been used up, the box is not generally regenerated for further use, so it should also be economical and easy to dispose of.

A first known type of box of the above type is cylindrical (in effect a piece of tubing) which is provided with ends, top and bottom, generally having metal ribs to reinforce the box itself Sometimes these boxes are provided with handles, either made of metal or other materials. These boxes are made of a specially tough material, which, however, is expensive. Further disadvantages of these boxes are that they have to be disposed of selectively, and are just as big when empty as when full.

Generally cubic boxes have been devised which are made up from folded card. These are economical, and can be easily and efficiently destroyed by the user, but are also only limitedly resistant and are therefore not favoured by producers as they cause problems during movement, nor are they preferred by users who often receive them in a deformed state, which renders the wire difficult to use. There exists a further problem, connected with the possible corrosion of the wire which usually happens during sea transport which at times can last for weeks or even months; none of the existing boxes obviates this problem.

SUMMARY OF THE INVENTION

The present invention provides a box which obviates all of the problems and drawbacks described above.

A further aim of the present invention is to provide a box whose size can be reduced when empty, which is nonetheless easy and fast to assemble and which, after use, can be easily and unproblematically disposed of.

An advantage of the invention is that it provides a box preventing corrosion of the wire contained in it, even where it is stored in potentially corrosive surroundings, such as in a ship's hold.

A further advantage of the invention is that it can be stored serially and stably, in considerable numbers.

These aims and advantages and others besides will all be attained by the present invention as it is characterised in the claims that follow.

BRIEF DESCRIPTION OF THE DRAWINGS

Further characteristics and advantages of the invention will better emerge from the detailed description that follows, of some preferred but non-exclusive embodiments, illustrated purely by way of non-limiting example in the accompanying figures of the drawings, in which.

DESCRIPTION OF THE PREFERRED EMBODIMENTS

Figure 1:
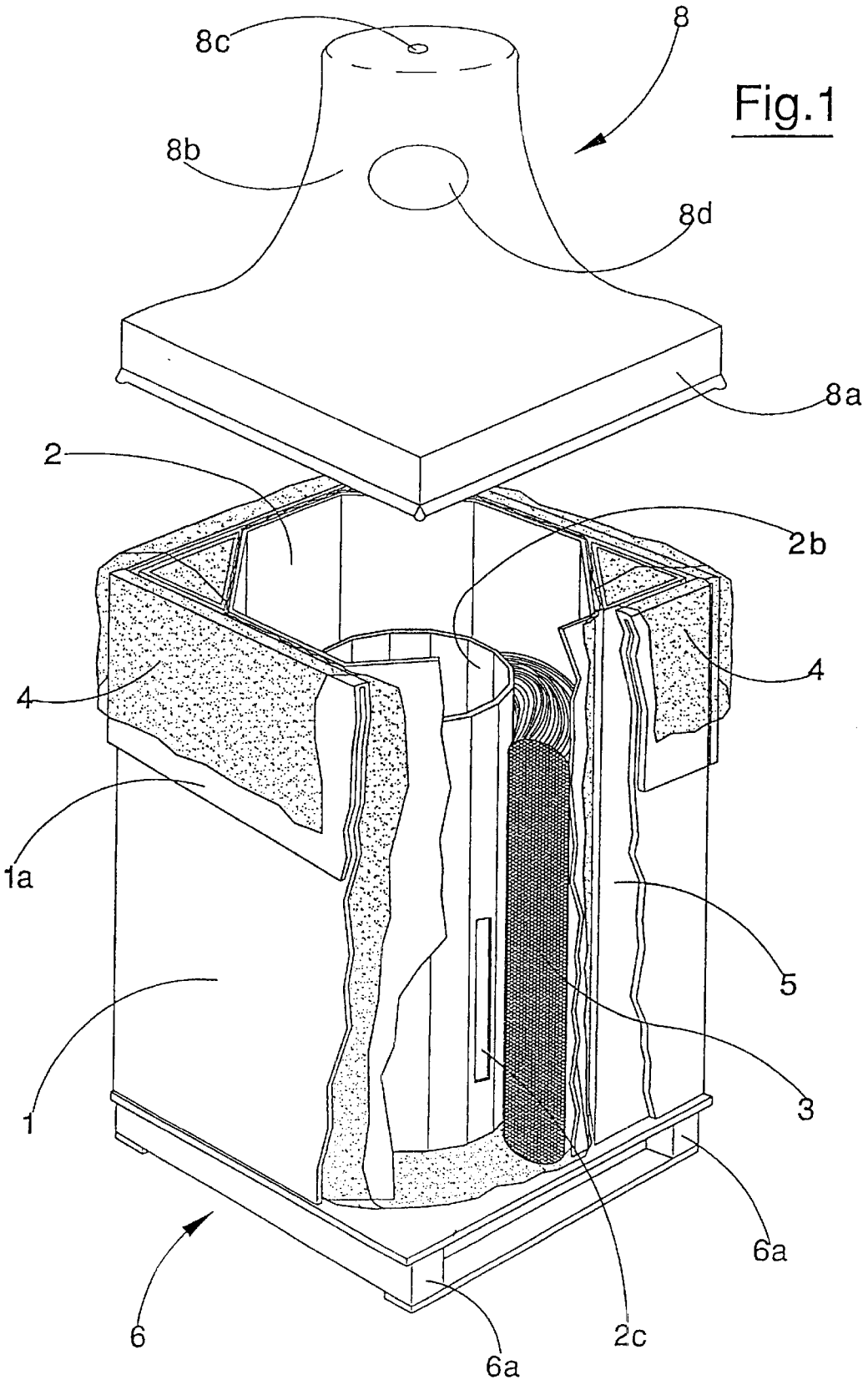
FIG. 1 is a perspective view, with some parts removed better to evidence others, of the box of the invention, in a non-closed configuration.
Figure 2:
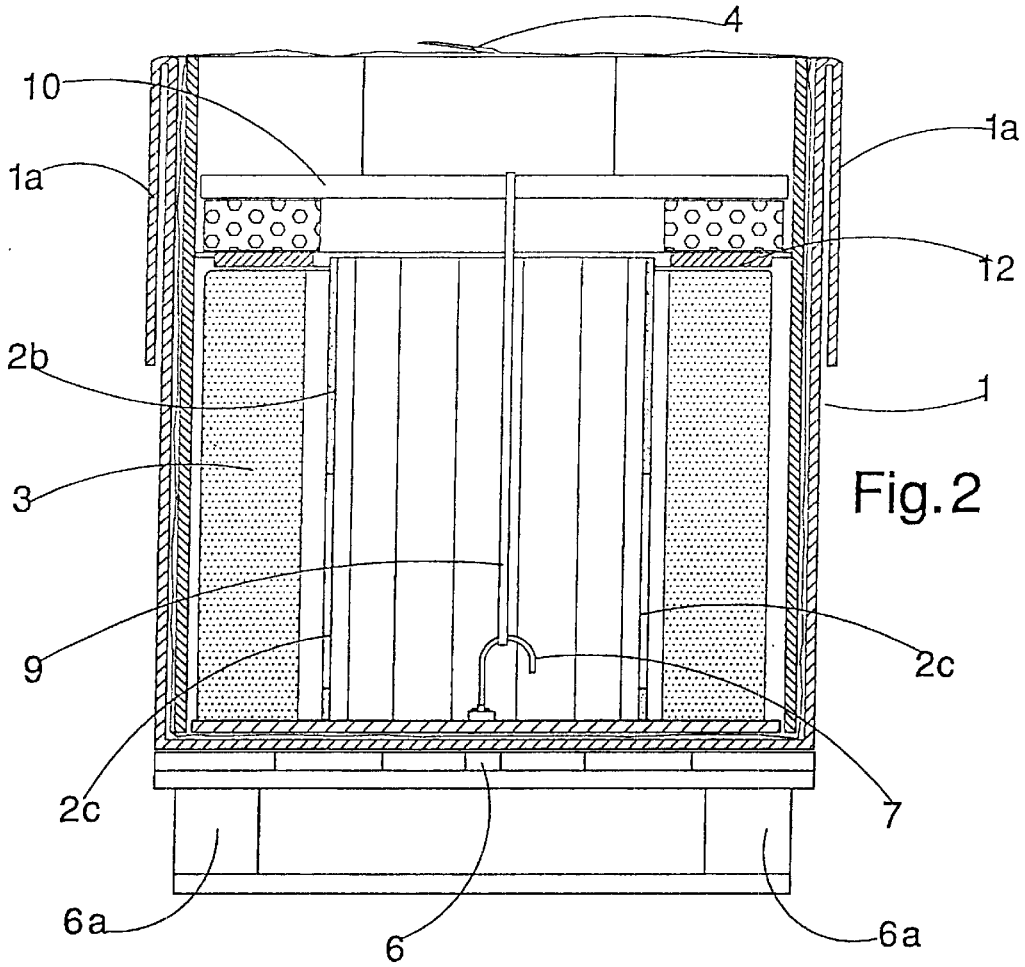
FIG. 2 is a vertical elevation of the box in the sealed configuration.
Figure 3:
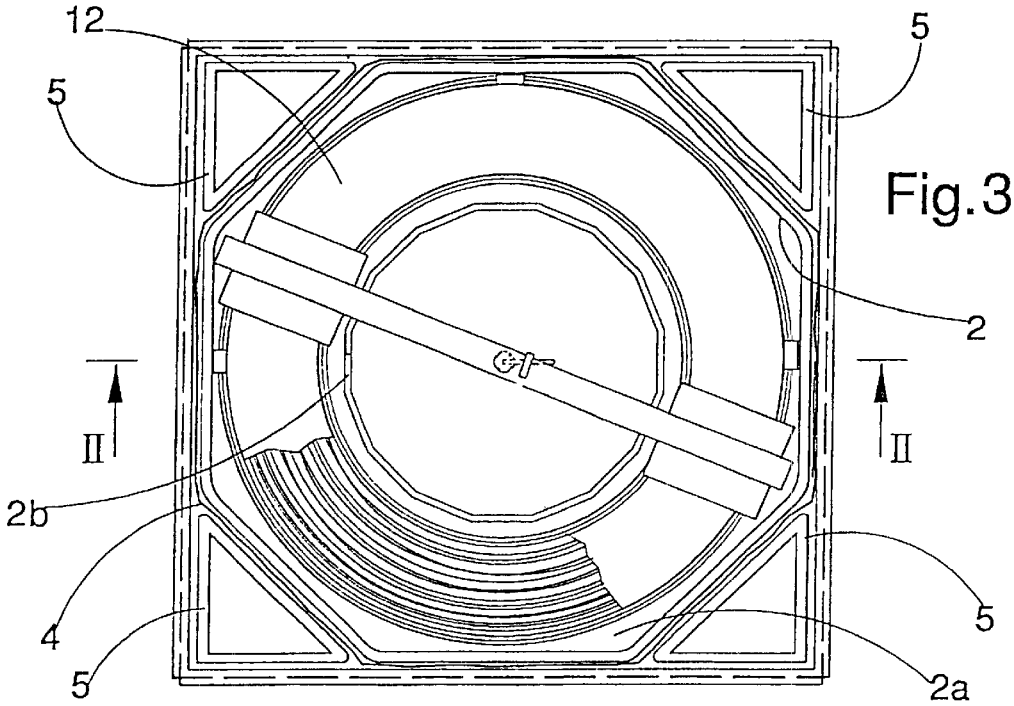
FIG. 3 is a view from above of the box, with some parts removed better to evidence others.

The box of the invention comprises an external container 1, cube-shaped, having a square bottom base and open at the top—in effect a normal cubic box with lateral flaps 1*a* which when closed constitute either the top or the bottom base. As is usual in these containers, the flaps 1*a* can be superposed one on another so as to obtain double-layer top and bottom bases. The container 1 is obtained by folding a sheet of pre-scored cardboard, with a connection at an edge, achieved by use of metal staples, for example, to obtain a lateral side of the container, and by folding the various lateral flaps and connecting them up, for example using adhesive tape, obtaining the bottom base and, when the container is to be closed, also the top base.

The box comprises a base pallet 6 to which the bottom of the box is anchored and which is the same size as the bottom base of the box. Metal staples could be used to anchor the box flaps to the pallet 6.

The pallet 6 is usually made of wood and comprises two parallel lower crossbeams 6*a* arranged slightly recessed from the base outline of the pallet 6 itself.

The box further comprises an internal container 2 which is octagonal and which fits snugly into the outer box 1; the internal container 2 is also of about the same height as the outer box 1, and is superiorly open (there is in effect no top base on the internal container 2). The internal container 2 is destined to container the coils of wire 3. The lateral sides of the internal container 2 are obtained by folding a pre-scored sheet of cardboard.

In a possible configuration of the box, the bottom base 2*a* of the internal container 2 is a flat octagonal element which is inserted snugly into the internal container 2 itself. An inner core 2*b* is coaxially inserted on the bottom base 2*a*; this inner core 2*b* is superiorly open and is obtained by folding a scored cardboard sheet having also tabs at one end which will fit into slits made in the base 2*a*. The inner core 2*b*, which is shorter than both containers so as not to obstruct the wire 3 movement, can advantageously be provided with longitudinal inspection slits 2*c* for visual inspection of the state of the wire coil in the box. A hook 7 can also be coaxially connected to the base 2*a*, to which, by means of an elastic band 9, a transversal fixture element 10 can be connected, constituted by a wooden rod or preferably a shaped piece of cardboard. The upper edge of the inner core 2*b* is usually provided with a smooth washer to facilitate wire movement.

Alternatively to the hook 7, with advantages both for the simplicity of construction and for disposal and destruction of the used box, beneath the base 2*a*, which may or may not be provided with the inner core 2*b* and which has a central hole, a stop is provided, for example a flat or elongate element which in any case does not pass through the hole, on which the elastic band 9 coming out of the central hole is threaded. The elastic band, as in the previous case and with the same functions, is connected to the fixture element 10. The bottom base of the internal container can also be left out, with the internal container consequently being made up only of the lateral surface; in this case the hook 7 can be connected directly to the base pallet 6.

As the above embodiments are obvious, they are not illustrated in the figures of the drawings.

In the spaces created at the edges of the external container, between the internal container and the external container, four triangular corner-pieces 5 made of folded cardboard are inserted. The corner-pieces 5 are of about the same height as the external container and are inserted during assembly of the container between the external and the internal containers.

Finally, a bag-type wrapping 4, made of flexible airtight material is interposed between the external and internal containers so as to envelop the internal container. The open end of the wrapping 4 faces and exits from the top base of the external container and is sealed once the coil has been introduced into the box.

For the wire unwinding/dispensing phase, a transparent plastic cover 8 is used. The cover 8 has a square-section base 8*a*, open downwards and of the right size to fit snugly on the box; it has a truncoconical upper zone 8*b* which affords a hole 8*c* at its top for the wire to come out of and a lateral opening 8*d* which gives access to the inside of the cover 8. The cover 8 is given to the user and can be re-used several times.

The box described is very simple and economical to make inasmuch as the constituent parts are all made of cheap materials (normal packaging cardboard, plastic or packaging papers, and low-grade wood for the pallet), and can be transported in flat packs and assembled directly at the wire producer's plant. First of all, the external container 1 is assembled and stapled before being stapled as a whole on to the pallet 6; the lateral surface of the internal container 2 is assembled and inserted into the wrapping 4, both then being introduced into the external container 1. Differently to the external container, the cardboard of the internal container might be advantageously covered at the join zone with adhesive paper so as to avoid superposing one cardboard edge over another for stapling, which might otherwise cause some difficulty when inserting the internal container into the external container.

Where the internal container is accompanied by an inner core and a base, first the inner core is assembled before being connected to the octagonal base. The hook 7, or stop to which the elastic band 9 exiting from the base 2*a* is already connected, is attached to the octagonal base. The assembly is then simply inserted into the internal container 2.

Where an internal container with no base is used, the hook 7, which in this case will be self-tapping, is simply connected up to the pallet 6.

The four triangular corner-pieces 5 are formed by folding the special cardboard blanks and inserted into the corner spaces.

As can be seen, the box can be fully assembled at the wire-producer's plant, the whole operation being rapid and simple.

The box is then arranged on a machine which inserts the wire coil. During this operation the upper lateral flaps of the external container are folded externalwise (see the figure) so as not to obstruct the introduction of the wire; the wrapper 4 can advantageously be folded down over the flaps so as keep them folded back.

Once the wire has been introduced, a brake element 12 is placed on the coil (the brake element 12 is schematically illustrated in the figures and is of known type). The brake element 12 has the function of favouring a correct unwinding of the wire. The fixture element 10 is then placed on the coil and anchored, by means of the elastic band 9, to the hook 7 or stop, which fix it with a downwards pull. As the inner core has the single function of preventing movements of the coil, the core itself, as has been mentioned, may even be left out. If this is the case, the transversal fixture element 10 might be provided with a cylindrical protuberance which could be inserted to a predetermined depth internally of the coil and removed together with the transversal fixture element, with considerable advantages when the coil is unwound.

When the coil has been introduced, the wrapper 4 is folded over the internal container and closed by heat-welding, gluing or any other like method, after thee air inside the wrapper has been removed by aspiration. The wire is now in a vacuum pack with obvious anticorrosion advantages. The lateral flaps are subsequently closed, using for example adhesive paper. The box is now ready for despatch.

Once it has arrived at its destination, the box is opened and the fixture element removed. The cover 8 is fixed on the box to facilitate wire unwinding. When empty, the box is easy to dispose of The wrapper 4 constitutes one of the particularities of the box, as thanks to its position between the internal and external containers it is not susceptible to tearing during transport, nor does it obstruct the operations of introduction and unwinding of the wire. What is more, it protects the internal container, and especially the coil of wire contained therein, from atmospheric agents, especially during sea transport. Another particularity of the box is the special conformation of the pallet 6 which, thanks to the slightly recessed position of the crossbeams 6*a* with respect to the base of the pallet itself, creating easily accessible gripping points, means that the whole box can be moved not only by means of the usual forklift trucks but also by bridge cranes equipped with normal slings whose hoist cables can be safely and easily located in the recesses created by the crossbeams 6*a*. Other types of box assemblies could also be used with the same pallet conformation.

Finally, the box, thanks to its "double container" conformation, exhibits considerable sturdiness, strength and protection for the coils of wire. Furthermore, thanks to the presence of the triangular corner-pieces 5, considerable resistance to compression is achieved. All of the foregoing is obtained using materials which are commonly considered to be of modest quality, and which are therefore extremely economical and easily recyclable.

What is claimed is:

1. A cardboard box for containing and dispensing large quantities of wire, comprising: a cubic square-base external container which can be opened at a top side thereof; an octagonal-base internal container being of such dimensions as to be fully containable within the square-base area of the external container, having about a same height as the external container and being destined to contain a coil of wire;

wherein a bottom base of the internal container is a flat octagonal element which inserts snugly into the internal container; and means engaged to said bottom base on which an elastic band is fastened.

2. The box of claim 1, comprising a bag-type wrapper made of a flexible air-tight material so that a vacuum can be created therein when closed, which wrapper is interposed between the external container and the internal container so that the internal container is contained within the wrapper, an open end of the wrapper projecting superiorly of the external container.

3. The box of claim 2, comprising four triangular corner-pieces made of folded cardboard, which are of about a same height as the external container and which insert between the external container and the internal container in empty spaces created at corner s of the external container when the internal container is fitted into the external container; in that it comprises a base pallet to which a bottom base of the external container is solidly anchored; and in that the pallet comprises two lower supporting crossbeams arranged parallel one to another; the crossbeams being slightly recessed from two parallel edges of the pallet.

4. The box of claim 1, comprising four triangular corner-pieces made of folded cardboard, which have about a same height as the external container and which are inserted between the internal container and the external container in empty spaces created at corners of the external container when the internal container is fitted into the external container.

5. The box of claim 1, wherein a bottom base of the external container is solidly anchored to a base pallet, which base pallet comprises two supporting crossbeams arranged parallel one to another; the crossbeams being slightly recessed from two parallel edges of the pallet.

6. The box of claim 1, comprising a cover made of transparent plastic which is provided with a square-section base which is open and which fits perfectly on an open end of the box; an upper zone of the cover being truncoconical and affording an upper hole for exit of the wire, and a lateral hole for access internally to the cover.

7. A cardboard box for containing and dispensing large quantities of wire as a packaged coil of wire, the coil having an axis, axially opposite ends and an axially extending outer periphery about the axis, said box comprising: a cubic square-base outer box having inwardly facing and outwardly facing box surfaces; and octagonal-base internal container having inwardly facing and outwardly facing container surfaces and being of such dimensions as to be fully containable within said square-base area of said outer box; a bag-type wrapper made of a flexible air-tight material so that a vacuum can be created therein when closed, said wrapper being interposed between said outer box and said internal container such that a portion of said outwardly facing container surfaces engages a portion of said wrapper which in turn engages a portion of said inwardly facing box surfaces, the outer periphery of the packaged coil is maintained by said inwardly facing container surfaces and said wrapper is separated from the outer periphery of the packaged coil by said internal container; said wrapper having an open end projecting superiorly of said outer box and said internal container having about the same height as said outer box.

8. The box of claim 7, further including four triangular corner-pieces made of folded cardboard, said corner pieces having about the same height as said outer box and which are interposed between said wrapper and said outer box at the vertically extending corners of said outer box when said internal container is fitted into said outer box.

9. The box of claim 8, further including a bottom base of said outer box which is solidly anchored to a base pallet, said base pallet comprising two supporting crossbeams arranged parallel to one another, said crossbeams being slightly recessed from two parallel edges of said pallet.

10. The box of claim 9, further including a bottom base of said internal container which is a flat octagonal element which inserts snugly into said internal container such that said wrapper is interposed between said bottom base of said internal container and said outer box.

11. The box of claim 10, further including an inner core being coaxially connected on said bottom base of said internal container, said inner core being superiorly open and having an inspection opening for allowing visual inspection of the package coil.

12. The box of claim 11, wherein said bottom base of said internal container includes a central hole; a stop being provided below said bottom base of said internal container and an elastic band being threaded on said stop, said elastic band extending superiorly from said central hole.

13. The box of claim 12, further including a cover made of transparent plastic which is provided with an opened square-section base which fits on an open end of said box; an upper zone of said cover being truncoconical and affording an upper hole for exit of the wire, and a lateral hole for access internally to the cover.

14. A cardboard box for containing and dispensing large quantities of wire as a packaged coil of wire, the coil having an axis, axially opposite ends and an axially extending outer periphery about the axis, said box comprising:

a cubic square-base outer box having inwardly facing and outwardly facing box side surfaces and a top portion defining a hole for removing the wire;

an octagonal-base internal container having inwardly facing and outwardly facing container surfaces and being of such dimensions as to be fully containable within said squarebase area of said outer box such that a portion of said outwardly facing container surfaces faces a portion of said inwardly facing box side surfaces and the outer periphery of the packaged coil is maintained by said inwardly facing container surfaces when the axis of the coil is parallel to box side surfaces, said internal container having about the same height as said outer box and having a top portion defining an opening, an inner core positioned coaxially with said internal container, said inner core being superiorly open and having an inspection opening for allowing visual inspection of the package coil;

a cover made of transparent plastic which is provided with an opened square-section base which fits on said top portion defining the open end of said box;

an upper zone of said cover being truncoconical and affording an upper hole for exit of the wire, and a lateral hole for access internally to the cover.

15. A cardboard box for containing and dispensing large quantities of wire as a packaged coil of wire, the coil having an axis, axially opposite ends and an axially extending outer periphery about the axis, said box comprising:

a cubic square-base outer box having inwardly facing and outwardly facing box side surfaces and a top portion defining a hole for removing the wire;

an octagonal-base internal container having inwardly facing and outwardly facing container surfaces and being of such dimensions as to be fully containable within said square-base area of said outer box such that a portion of said outwardly facing container surfaces faces a portion of said inwardly facing box side surfaces and the outer periphery of the packaged coil is maintained by said inwardly facing container surfaces when the axis of the coil is parallel to box side surfaces, said internal container having about the same height as said outer box and having a top portion defining an opening, four triangular corner-pieces made of folded cardboard, said corner pieces having about the same height as said outer box and which are interposed between said inner container and said outer box at the vertically extending corners of said outer box when said internal container is fitted into said outer box, and a bottom base at the bottom of said internal container, said bottom base being a flat octagonal element which inserts snugly into said internal container.

16. The box of claim 15, wherein said bottom base of said internal container includes a central hole; a stop being provided below said bottom base of said internal container and an elastic band being threaded on said stop, said elastic band extending superiorly from said central hole.

17. The box of claim 16, further including a cover made of transparent plastic which is provided with an opened square-section base which fits on an open end of said box; an upper zone of said cover being truncoconical and affording an upper hole for exit of the wire, and a lateral hole for access internally to the cover.

18. A cardboard box for containing and dispensing large quantities of wire as a packaged coil of wire, the coil having an axis, axially opposite ends and an axially extending outer periphery about the axis, said box comprising:

a cubic square-base outer box having inwardly facing and outwardly facing box side surfaces and a top portion defining a hole for removing the wire; an octagonal-base internal container having inwardly facing and outwardly facing container surfaces and being of such dimensions as to be fully containable within said square-base area of said outer box such that a portion of said outwardly facing container surfaces faces a portion of said inwardly facing box side surfaces and the outer periphery of the packaged coil is maintained by said inwardly facing container surfaces when the axis of the coil is parallel to box side surfaces, said internal container having about the same height as said outer box and having a top portion defining an opening, a bottom base of said outer box which is solidly anchored to a base pallet, said base pallet comprising two supporting crossbeams arranged parallel to one another; said crossbeams being slightly recessed from two parallel edges of said pallet, and a bottom base of said internal container which is a flat octagonal element which inserts snugly into said internal container.

19. The box of claim 18, further including a cover made of transparent plastic which is provided with an opened square-section base which fits on an open end of said box; an upper zone of said cover being truncoconical and affording an upper hole for exit of the wire, and a lateral hole for access internally to the cover.

20. A cardboard box for containing and dispensing large quantities of wire as a package coil of wire, the coil having an axis, axially opposite ends and an axially extending outer periphery about the axis, said box comprising: a cubic square-base outer box having inwardly facing and outwardly facing box surfaces and a top end opening for removing the wire; an internal container having inwardly facing and outwardly facing container surfaces and being of such dimensions as to be fully containable within said square base area of said outer box such that a portion of said outwardly facing container surfaces face a portion of said inwardly facing box surfaces and the outer periphery of the packaged coil is maintained by said inwardly facing container-surfaces; and a bag-type wrapper made of a flexible air-tight material so that a vacuum can be created therein when closed, said wrapper being interposed between and engaged to said outer box and said internal container so that said wrapper is separated from the outer periphery of the packaged coil by said internal container.

21. The box of claim 20, further including an inner core positioned coaxially within said internal container, said inner core being superiorly open and having an inspection opening for allowing visual inspection of the package coil.

22. The box of claim 21, further including a cover made of transparent plastic which is provided with an opened square-section base which fits on an open end of said box; an upper zone of said cover being truncoconical and affording an upper hole for exit of the wire, and a lateral hole for access internally to the cover.

23. The box of claim 20, further including a cover made of transparent plastic which is provided with an opened square-section base which fits on an open end of said box; an upper zone of said cover being truncoconical and affording an upper hole for exit of the wire, and a lateral hole for access internally to the cover.

24. The box of claim 20, further including a bottom base of said outer box which is solidly anchored to a base pallet, said base pallet comprising two supporting crossbeams arranged parallel to one another; said crossbeams being slightly recessed from two parallel edges of said pallet.

25. A cardboard box for containing and dispensing large quantities of wire as a packaged coil of wire, the coil having an axis, axially opposite ends and an axially extending outer periphery about the axis, said box comprising:

a cubic square-base outer box having inwardly facing and outwardly facing box surfaces;

an octagonal-base internal container means having inwardly facing and outwardly facing container surfaces and being of such dimensions as to be fully containable within said square-base area of said outer box such that a portion of said outwardly facing container surfaces faces a portion of said inwardly facing box surfaces and the outer periphery of the packaged coil is maintained by said inwardly facing container surfaces, said internal container having about the same height as said outer box, and wherein said container means includes a rigid potion and a bag portion made of a flexible air-tight material so that a vacuum can be created therein when closed, said bag portion surrounding said rigid portion and being interposed between said outer box and said rigid portion so that said bag portion is separated from the outer periphery of the packaged coil by said rigid portion; an open end of said wrapper projecting superiorly of said outer box.

* * * * *